US006550078B1

(12) United States Patent
Brown et al.

(10) Patent No.: US 6,550,078 B1
(45) Date of Patent: Apr. 22, 2003

(54) HEAD AND NECK SUPPORT FOR SALON SHAMPOO BOWL

(75) Inventors: Joy Anderson Brown, Watkinsville, GA (US); Paula Thaxton Hansford, Watkinsville, GA (US)

(73) Assignee: Hansford & Brown, Inc., Watkinsville, GA (US)

( * ) Notice: Subject to any disclaimer, the term of this patent is extended or adjusted under 35 U.S.C. 154(b) by 0 days.

(21) Appl. No.: 10/068,798

(22) Filed: Feb. 6, 2002

Related U.S. Application Data

(60) Provisional application No. 60/266,616, filed on Feb. 6, 2001.

(51) Int. Cl.[7] ..... A45D 44/10

(52) U.S. Cl. ..... 4/523; 4/519; 4/515; 4/575.1

(58) Field of Search ..... 4/523, 519, 575.1, 4/515, 579, 578.1, 573.1, 571.1, 530, 531; 297/391, 399, 400, 401, 406; D23/308

(56) References Cited

U.S. PATENT DOCUMENTS

| | | | | | |
|---|---|---|---|---|---|
| 2,013,823 | A | * | 9/1935 | Chancer | 4/523 |
| 2,496,684 | A | * | 2/1950 | Upchurch | 4/515 |
| 2,503,145 | A | * | 4/1950 | Zukor | 4/575.1 |
| 2,607,637 | A | * | 7/1952 | Moore | 4/575.1 |
| 3,295,146 | A | * | 1/1967 | Martin et al. | 4/575.1 |
| 4,196,478 | A | | 4/1980 | Cowell | |
| 4,327,452 | A | | 5/1982 | Swatzell | |
| 4,352,216 | A | | 10/1982 | Grim | |
| 4,411,032 | A | | 10/1983 | Lewy | |
| 4,546,504 | A | * | 10/1985 | Vars | 4/516 |
| 4,649,580 | A | | 3/1987 | Bastien | |
| 4,711,486 | A | | 12/1987 | Fujiyama | |
| 4,763,364 | A | | 8/1988 | Morgan | |
| 4,821,347 | A | | 4/1989 | Nash | |
| 4,834,121 | A | | 5/1989 | Bell | |
| 4,918,767 | A | | 4/1990 | Benting | |
| 4,956,881 | A | | 9/1990 | Lindley et al. | |
| 4,998,303 | A | | 3/1991 | Smithers | |
| 5,022,102 | A | | 6/1991 | Louvaris | |
| 5,025,514 | A | | 6/1991 | Miller | |
| 5,144,701 | A | | 9/1992 | Clark | |
| 5,177,820 | A | | 1/1993 | Varallo | |
| 5,239,711 | A | | 8/1993 | Tafur | |
| 5,247,712 | A | | 9/1993 | Williams | |
| 5,257,851 | A | | 11/1993 | Kanaya | |
| 5,289,597 | A | | 3/1994 | Sidola | |
| 5,393,297 | A | | 2/1995 | Kristoff | |
| 5,692,251 | A | | 12/1997 | Page | |
| 5,862,542 | A | | 1/1999 | Page | |
| 5,893,396 | A | | 4/1999 | Vagle | |
| 5,896,595 | A | | 4/1999 | Spencer | |
| 5,946,745 | A | | 9/1999 | Magee | |
| 6,123,389 | A | * | 9/2000 | O'Connor et al. | 297/399 |

* cited by examiner

*Primary Examiner*—Robert M. Fetsuga
*Assistant Examiner*—Khoa Huynh
(74) *Attorney, Agent, or Firm*—Needle & Rosenberg, P.C.

(57) ABSTRACT

A head and neck support for salon shampoo bowls is disclosed. The device is constructed and arranged to support a client's head and neck over a shampoo bowl in order to reduce the likelihood of strains and discomfort to the client and the hair stylist. The head and neck support is constructed to be received within a shampoo bowl and suspended by a strap provided with grasping elements for being passed over the sides of the bowl, and a hook like extended tongue passed through and supported by a neck depression defined within a front wall of the bowl.

25 Claims, 7 Drawing Sheets

HEAD AND NECK SUPPORT FOR SALON SHAMPOO BOWL

CROSS-REFERENCE TO RELATED PATENT APPLICATION

This application claims priority to provisional U.S. Patent Application Serial No. 60/266,616, filed in the United States Patent and Trademark Office on Feb. 6, 2001, entitled "Head and Neck Support for Salon Shampoo Bowl."

FIELD OF THE INVENTION

The invention relates in general to the health and beauty industry, and devices used therewith. More particularly, the invention relates to a head and neck support for use in supporting the head of a person over a salon shampoo bowl while receiving a shampoo or other hair or facial treatments.

BACKGROUND OF THE INVENTION

As known, the clients of a beauty salon, for example, who receive any type of a treatment or procedure which requires the washing or wetting of their hair, or a facial treatment, typically recline in a chair and place their neck through and onto a U-shaped opening formed in the side of a shampoo bowl, and lean their head back into the bowl. Without support, this posture causes the neck of the client to lie at an unnatural angle and may strain the client's neck, spine, and back muscles. The weight of the client's head with wetted hair combined with the forces exerted by a cosmetologist applying treatment or washing the hair can hyperextend the client's neck causing strain to neck muscles, damage to cervical vertebrae, and retard the flow of oxygen to the brain causing strokes or transient ischemic attacks.

Salon sink radiculopathy, or injury to nerve roots leading from the spinal cord to the extremities, is a medical condition believed to pose an increased risk of injury to people with problems such as arthritis or prior neck injuries resulting from traffic, work, or sports accidents. Treatments for radiculopathy include medication, therapy, and even surgery. To prevent neck and spinal discomfort or injury to a client, therefore, a cosmetologist oftentimes has to physically grasp and support the client's head during any such treatments or procedures which in turn induces a strain in the cosmetologist's back, neck, and arms, and may also lead to him/her coming into contact with the chemicals and/or solutions being used for the client's treatment.

Prior attempts have been made to deal with this problem. For example, the patent to Page, U.S. Pat. No. 5,862,542, discloses a shampoo headrest with a support post atop of which is a cup onto which the client lays their head. The cup provides some support for the client's head, and allows the cosmetologist to use both of their hands during a hair care treatment, for example. Problems with the device of the '542 patent, however, are that it appears to be complicated to install, does not provide any neck support for the user, provides little support to the entire head as the client's head rests only on the small area of the cup, and there is little room allowed for the client to turn their head without otherwise falling off of the support. Moreover, as the cosmetologist must lift the client's head for rinsing, the design of the device makes it difficult to rinse the client's hair, and it appears this device would be uncomfortable for use with perm rollers and the like.

U.S. Pat. No. 5,177,820 to Varallo, discloses a hairdressing head support which mounts on a shampoo bowl. The head support holds the client's head upright while partially enveloping the client's head. The device of Varallo has disadvantages in that the customer's head appears to remain upright, thus allowing the client's face and/or shoulders to get wet when their hair is being washed and/or rinsed. The '820 device is also complex with many parts to adjust, and makes the rinsing and moving of the client's head difficult.

Another headrest for shampoo bowls and sinks is disclosed in U.S. Pat. No. 5,239,711, which illustrates a rectangular mesh strip which spans a shampoo bowl and attaches to either side thereof. The mesh strip may be adjusted to fit varying sizes of bowls and may be moved to various positions relative to the front of the bowl. The disadvantages of this device, however, are that it provides no support to the client's neck, cannot be adjusted in height, perm rods and rollers, and possibly the stylist's fingernails, may get caught in the device, the client's hair may also could get caught in the device, and the device makes it difficult to rinse the client's hair.

The sealed neck support for shampoo bowls of U.S. Pat. No. 4,649,580 is adapted to be installed in the U-shaped indention in the side of a shampoo bowl, and is designed to cushion the client's neck. The product clips onto the U-shaped portion of the bowl opening, and has a membrane which forms a leak barrier to keep the client from getting wet. A disadvantage of the '580 device, however, is that it does not provide support for the client's head as it only cushions or seals against the neck in the U-shaped opening.

U.S. Pat. No. 4,998,303 illustrates a head support for a salon basin having a perforated headrest plate that sits inside the shampoo bowl, and is formed to be concave to fit the client's head. The plate is attached to the front rim of the bowl with bendable hooks and is further supported by a threaded support member which is adjustable in length and engages the inner surface of the bowl. The device of the '303 patent appears to be shaped in such a manner so as to not allow the client's head to turn completely from side to side during shampooing or rinsing. Further, the holes in the plate appear to be large enough to allow hair to pass therethrough during hair treatment procedures, the device provides no support to the neck, and the height of the device relative to the top of the shampoo bowl cannot be raised or lowered for various hair and facial treatments.

The permanent wave headrest attachment of U.S. Pat. No. 4,352,216 was designed for supporting the head while rinsing permanent waves. This device provides a plastic frame covered with a mesh panel to support the head. The device hooks to the shampoo bowl via a rigid strap hanger which adjusts to fit various bowls. The design of the '216 patent appears to be such that hair and rollers would easily be caught in the mesh panel, however. In addition, the device is suitable for use only for a shampoo bowl with a downturned lip at an outer edge, therefore use of the device with a bowl of alternate edge construction does not appear possible.

What is needed, but seemingly unavailable from the known devices, is a head and neck support adapted for use as a salon sink or shampoo bowl, that can be easily fit to any such sink or bowl, and which fully supports the head of a client to prevent hyperextehsion of the client's neck and damage to cervical vertebrae. Also needed is a head and neck support so constructed and installed that a cosmetologist or other beauty care professional need not physically support the patron's head during the desired treatments or procedures.

SUMMARY OF THE INVENTION

An improved head and neck support for use with a salon shampoo bowl which overcomes some of the design deficiencies of the art is disclosed. The head and neck support of this invention is constructed and arranged to be suspended within the shampoo bowl and to support a salon client's head over the shampoo bowl in hands-free fashion with the client's neck in a neutral position, and which also will reduce the likelihood of strains and discomfort to both the client and the hair stylist.

This is accomplished by providing a head and neck support for use with a shampoo bowl comprising a head support piece, at least one elongate strap, and at least one, and preferably a pair, of grasping elements affixed to the at least one strap. The grasping elements are each sized and shaped to be passed over the edge or lip of the shampoo bowl side walls, and the support piece is suspended within the bowl by the at least one strap and the grasping elements as they each grasp the top edge of the shampoo bowl side wall(s), and by an elongate tongue extended from the support piece which is sized and shaped to be passed through and supported on a U-shaped neck depression or opening defined within a front wall of the shampoo bowl. The support piece may also comprise an elongate shelf with a series of slots defined therein for passing the at least one strap therethrough.

The head and neck support device of this invention, constructed and suspended within the shampoo bowl as described above, may thus be raised or lowered relative to the plane of the shampoo bowl by adjusting the length of the at least one strap, which thus enables the position of the client's head to be changed during various hair and/or facial treatments. The shape of the head pan allows clients to easily turn their head during a hair treatment without the head otherwise falling off of the head and neck support, or otherwise catching any rollers, perm rods, and other accessories used for either the hair or facial treatment the client is receiving. The device is also designed to allow the hair and the head to be easily rinsed, and may be used for multiple procedures, such as shampooing, rinsing, perms, waxing, facials, and the like.

The design of the head support piece also allows the cosmetologist to move their hands freely about the client's head and within the bowl, and allows the cosmetologist to use both of their hands during any such procedures without having to otherwise physically support the client's head themselves, thus reducing the likelihood of back and neck strain to the cosmetologist. An additional feature of the head and neck support device of this invention is that it also allows cosmetologists to minimize the contact of their hand(s) with any harsh chemicals, for example a bleach, that might be used in the treatment the client is receiving as the hand(s) are not used to support the client's head.

The head and neck support is preferably made of durable materials which will be impervious to chemicals of the type used in the salon, yet comfortable to the user when their head is received thereon and supported during the desired beauty care treatments. The device is designed to fit a wide variety and size of shampoo bowls, and the tongue of the support piece is narrow enough to fit in nearly all U-shaped neck openings of such shampoo bowls, yet is still wide enough to provide adequate and comfortable support for the client's neck during the use of the device. The arc of the neck piece has also been shaped to provide the client maximum comfort, and the device is easily cleaned.

The head and neck support also includes a shelf extended therefrom and through which the strap or straps used with the device is/are threaded, and ribbing on the underside of the head support piece to provide maximum strength thereto. The device is simple and easy to install within and remove therefrom virtually all known types of shampoo bowls.

DETAILED DESCRIPTION OF THE INVENTION

Figure 1:
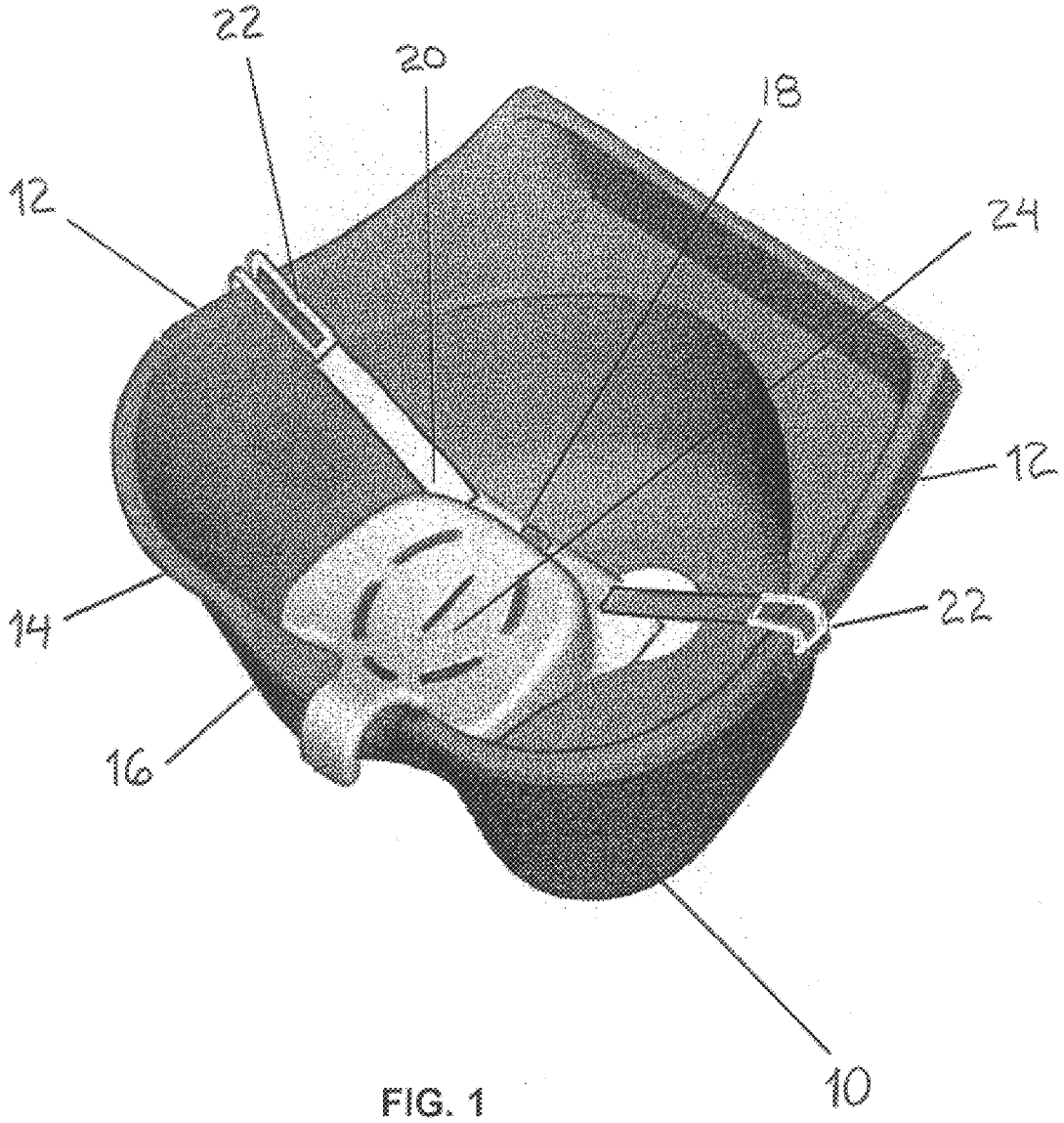
FIG. 1 is a perspective view of a preferred embodiment of the inventive head and neck support positioned and suspended within a shampoo bowl.

Referring now in detail to the drawings, in which like reference numerals indicate like parts throughout the several views, a known type of salon shampoo bowl 10 is illustrated in FIG. 1, with a pair of opposed sidewalls 12, and a front wall 14 with a U-shaped neck depression or opening 16 defined therein. A preferred embodiment of a hands-free head and neck support 18 of this invention is shown fitted within the bowl 10. An elongate strap 20 is provided with a pair of grasping elements 22 thereon and is used to secure a support piece 24 to the shampoo bowl. The strap enables the head and neck support to be fitted to shampoo bowls of varying size.

Figure 2:
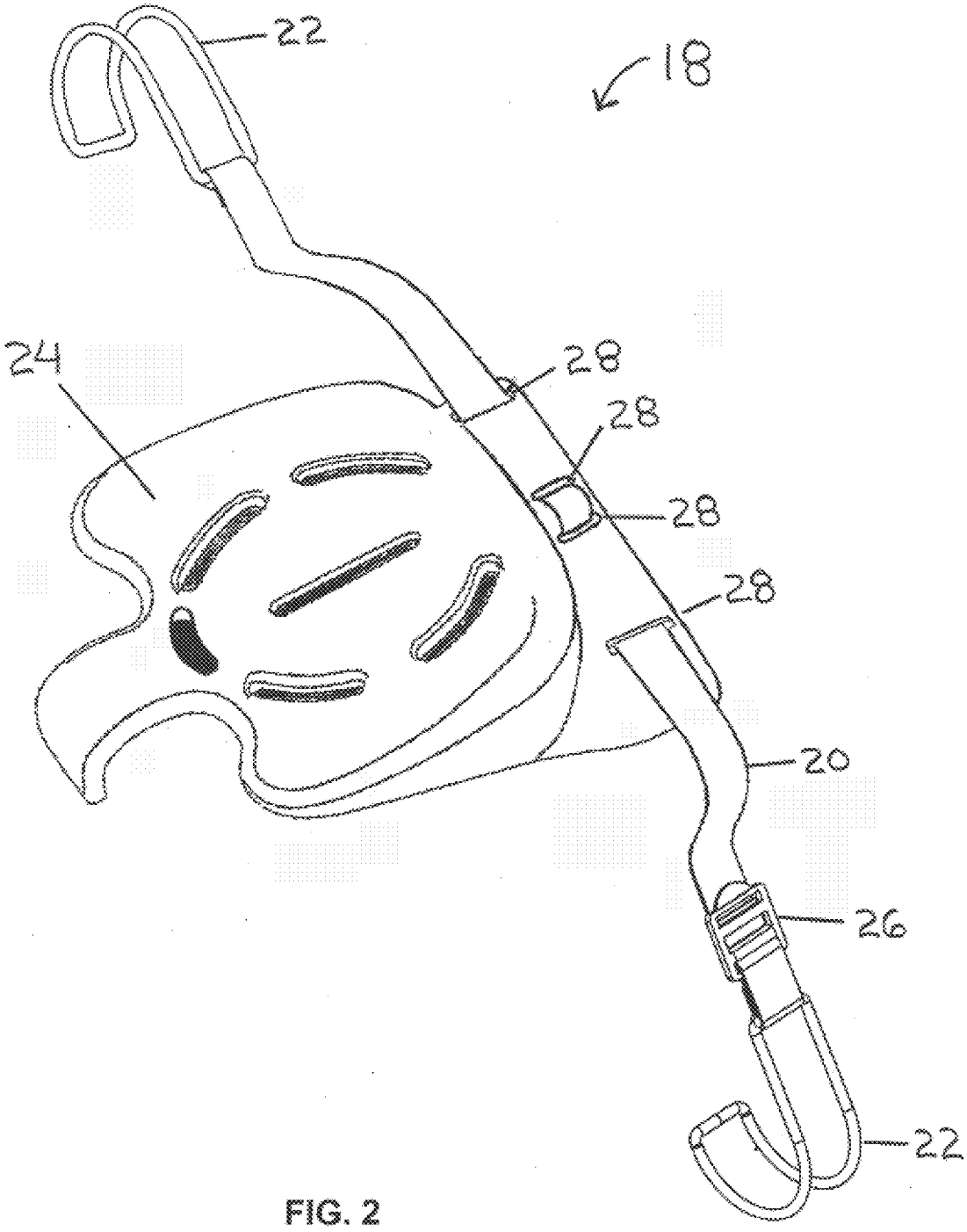
FIG. 2 is a top perspective view of the head and neck support of FIG. 1.

The head and neck support of FIG. 1 is illustrated in further detail in FIG. 2. The head and neck support comprises the support piece 24, the pair of grasping elements 22, and the strap 20 which may be provided with a length adjuster 26. The strap has attached thereto the grasping elements at the opposite ends of the strap, and the strap passes through several strap slots 28 defined within and extended through the support piece.

Figure 3:
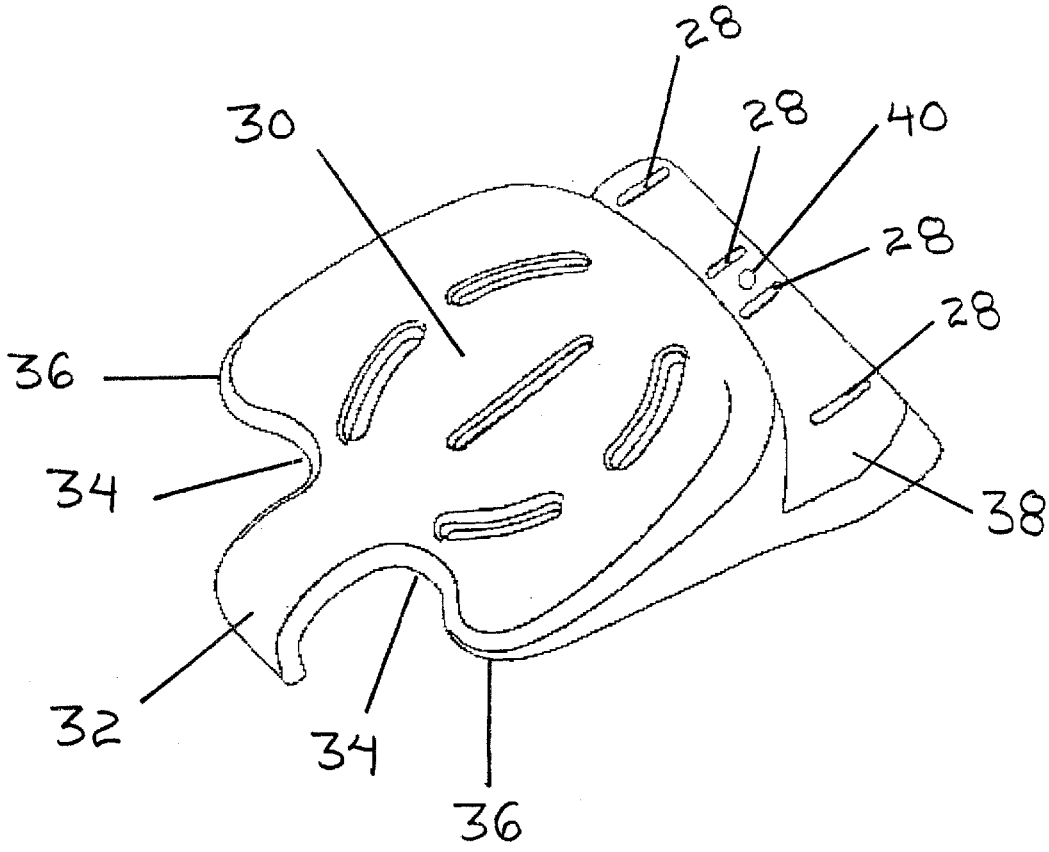
FIG. 3 is a top perspective view of an alternate embodiment of the support piece of FIG. 1.

Referring now to FIG. 3, an alternate embodiment of the support piece of FIG. 1 comprises a head pan 30, an elongate tongue 32 extended from the head pan, a pair of arcuate cutouts 34 defined about the tongue, a pair of shoulders 36 formed by the cutouts, and an elongate shelf 38 extended from the support piece opposite the tongue and below the plane or elevation of the head pan. The head pan is sized and shaped to support the head of the client over a shampoo bowl in concert with the strap and grasping elements.

The tongue 32 is designed to pass through and hook over and outside the U-shaped neck depression 16 defined in the shampoo bowl (FIG. 1) in order to support the client's neck and allow the client to comfortably recline with respect to the shampoo bowl, thus reducing client neck strain. The shelf 38 may be formed as a part of the head pan, or is otherwise provided (e.g., adhered thereto) and extended therefrom opposite the tongue and provides extra strength to the head pan. The plurality of strap slots 28 defined within the support piece together define a channel through which the strap 20 (FIG. 2) is passed for supporting the head pan, and also allowing for vertical movement thereof relative to the horizontal plane of the bowl 10. The shelf may be preferably positioned below the elevation of the head pan to provide a maximum range of height adjustment for the support piece. A raised boss 40 positioned atop the shelf may be formed with the support piece or attached thereto, and is positioned between two of the strap slots to separate or lift the strap from the plane of the shelf, as illustrated in FIG. 1, in order to provide for convenient grasping of the strap by the fingers of the user whenever it is desirable to adjust or pass the strap within the slots.

The shoulders 36 are formed by the arcuate cutouts 34 about the tongue 32, so that when the support piece is positioned within the shampoo bowl 10 (FIG. 1) with the tongue extended through the neck opening 16, the shoulders abut the front wall 14 of the bowl providing resistance to any rocking or displacement of the support piece as the head of the client may be moved or rocked during hair or facial treatment.

Figure 4:
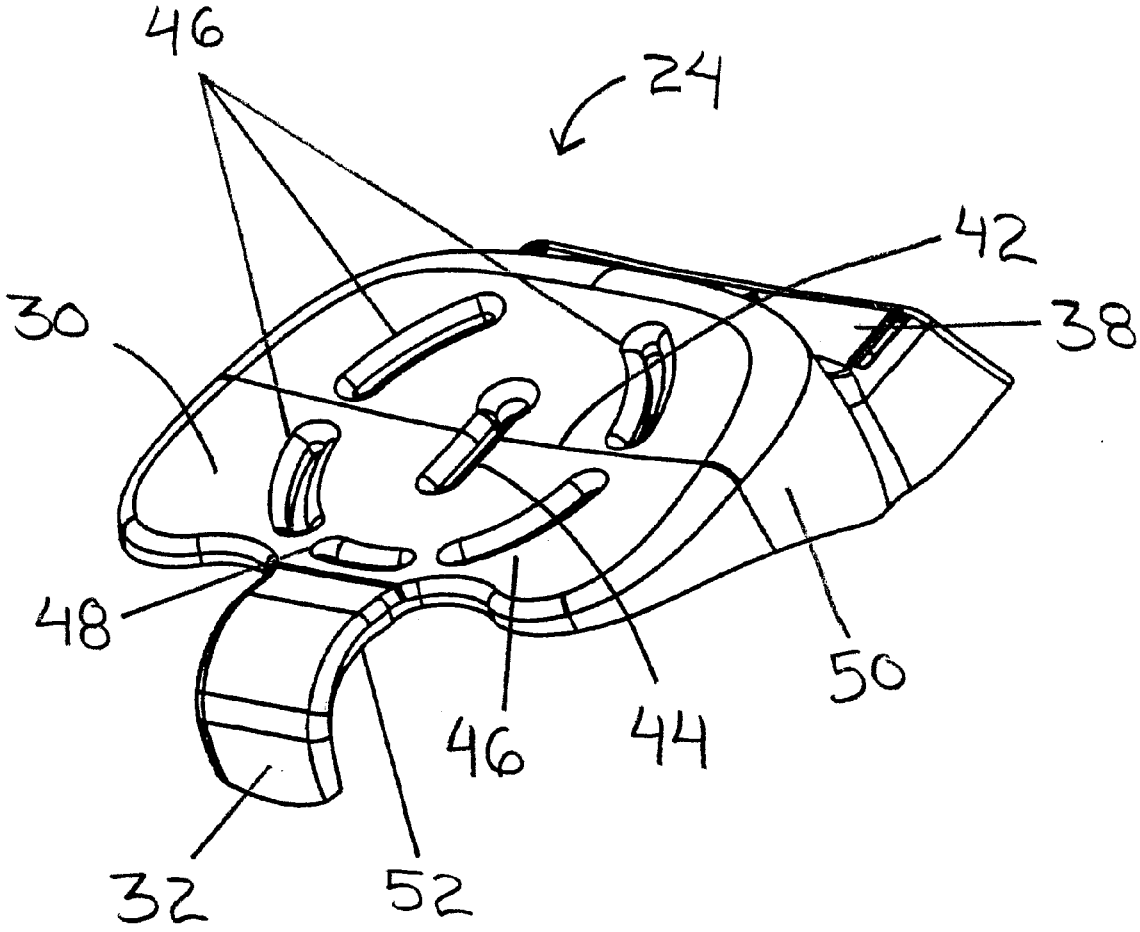
FIG. 4 is a top perspective view of the support piece of the head and neck support of FIG. 1.

As illustrated in FIG. 4, the support piece 24 of the head and neck support of FIG. 1 has a shallow concave depression 42 formed in the head pan for comfortably receiving or seating the client's head therein. A desired number of drain openings, here six drain slots, may be defined in the top facing surface of the head pan to allow for water drainage and hands-free rinsing of the client's hair, for example. An elongate drain slot 44 is shown positioned centrally within the head pan, and a plurality of, in this instance four, arcuate drain slots 46 are positioned concentrically thereabout to provide for adequate drainage of rinse water and treatment solutions. The support piece 24 also includes a neck support drain slot 48, also defined within the head pan and at the base of the tongue, which drain slot provides for the drainage of solutions that might otherwise flow over the tongue, out of the shampoo bowl, and onto the floor or client's clothing. The drain slots may each be formed as illustrated with a rounded peripheral edge defined within the top facing surface of the head pan to avoid the client's head coming into contact with sharp or angled top surface features, or as otherwise desired. The arcuate cutouts 34 (FIG. 3) assist the drain slots by providing drainage paths peripheral to the head pan thereby helping to prevent the overflow of rinse water and treatment solutions over the tongue. Although the plurality of drain openings illustrated in FIG. 4 comprise six drain slots, the drain openings may, in alternate aspects of the support piece, comprise other shaped openings, for example circular holes, in any desired number and placement arrangement.

The support piece 24 may further comprise a side wall 50 (FIG. 4) extended from each of the two sides of the head pan 30 between the forward tongue 32 and the rear shelf 38. Each side wall 50 strengthens the support piece and is preferably angled slightly away from the head pan in order to minimize splashing from solutions pouring over the side of the head pan and into the shampoo bowl. A rear side wall extended from the head pan to the rear shelf may be provided to raise the elevation of the head pan above the shelf and to further strengthen the support unit. A side wall 52 extends along each side of the tongue providing strength to the tongue. The side wall 52 may be greater in height proximal the head pan and lesser in height distal the head pan to allow for proper seating of the tongue within the neck depression 16 (FIG. 1) of the shampoo bowl.

Figure 5:
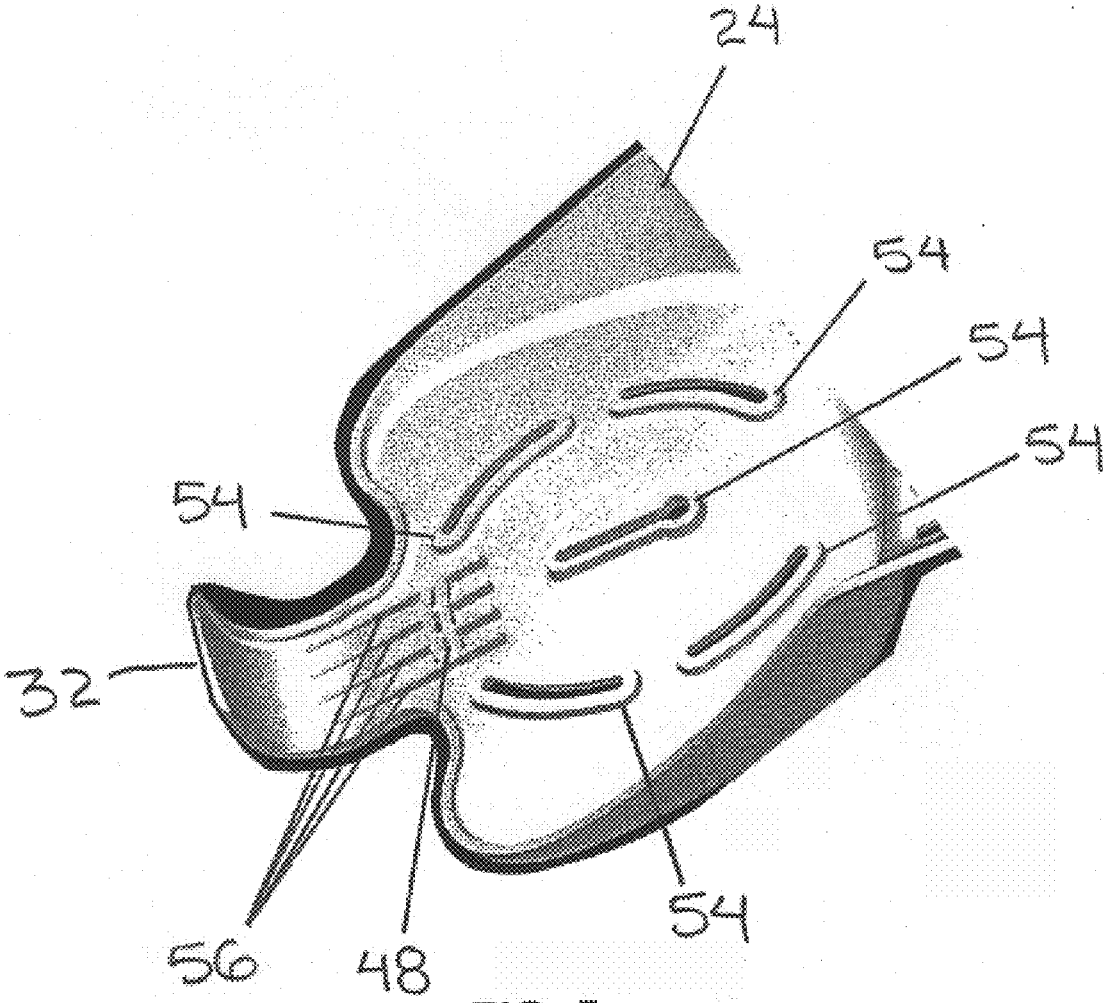
FIG. 5 is a bottom perspective view of the support piece of FIG. 4.

Illustrated in FIG. 5 is the underside of the support piece 24 of FIG. 4. A continuous and peripheral rib 54 extends away from the bottom surface of the head pan along the edge of each of the drainage slots defined or otherwise formed in the top surface of the head pan. A series of ribs 56 provides rigidity and strength at the base of the tongue 32 by transversely spanning the neck support drain slot 48.

In all of its embodiments, the support piece 24 is preferably made of a moldable plastic having sufficient rigidity and resistance to chemical corrosion or attack from the chemical or cleansing agents being used in any hair and/or facial procedures being performed. The support piece may thus comprise an elastomeric material, and/or may comprise polypropylene, polyethylene, ABS plastic, or rubber. The support piece may also be of a multi-layer laminated construction with a soft finish material passed over or received on a semi-rigid frame. The exterior surface of the support piece may also comprise a lightly textured suspense pattern (not illustrated) to provide for improved solution draining therefrom and to further minimize the appearance of minor scratches therein resulting from regular use and abrasions from, for example, hair rollers, combs, and a cosmetologist's finger nails.

Figure 6:
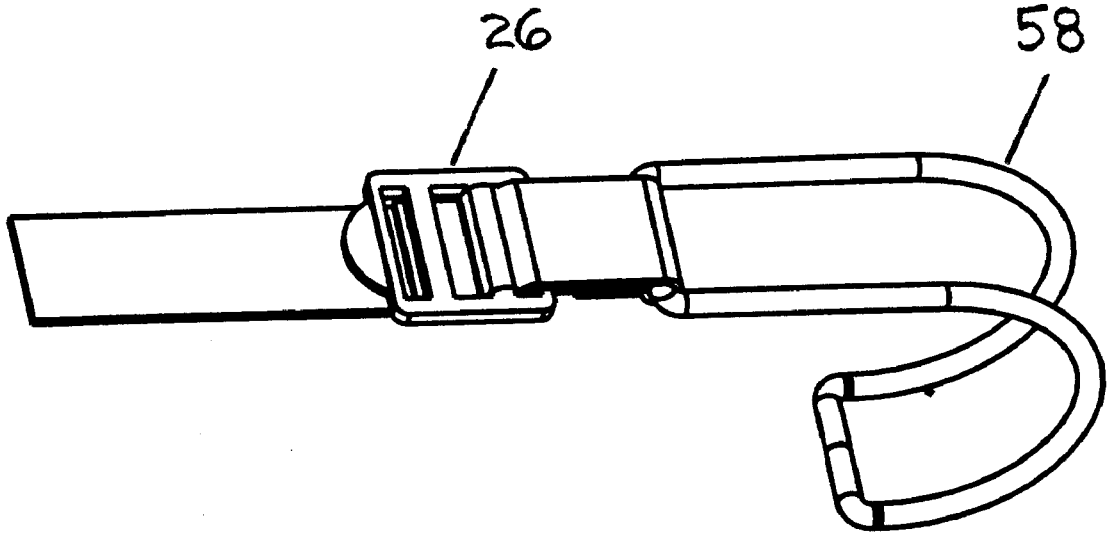
FIG. 6 is a perspective view of the grasping element and adjuster of the head and neck support of FIG. 1.

The grasping elements 22 (FIG. 1) are provided to attach the strap 20 to the opposing side walls 12 of shampoo bowl 10 to thereby suspend the support piece within the bowl. As illustrated in FIG. 6, each grasping element may comprise an open hook 58, shaped to pass over and grasp the top edge of the side walls of the bowl. Each hook may be formed of a continuous rigid material and shaped to allow passage of the strap therethrough, or as otherwise desired.

The adjuster 26 may be provided as a part of the strap assembly to allow user control of the length and tension of the strap. The adjuster may comprise any conventional buckle or clasp for use with straps and/or belts. Alternatively, end portions of the strap may further comprise a hook and loop fastener material, industrial strength VELCRO® for example, to allow adjustment and securing of the length of the strap once the proper adjustment, or tensioning, of the strap has been made. The strap may also comprise a plurality of straps, for example two straps, with each such strap being separately attached, for example by stitching or a weld, to a grasping element with an adjuster or buckle positioned therebetween, as illustrated in FIG. 6. Thus, the support piece 24 (FIG. 1) may be supported within the bowl by a strap or straps in a length or tension adjustable arrangement for suspending the support piece with the strap and the grasping elements 22.

Figure 7A:
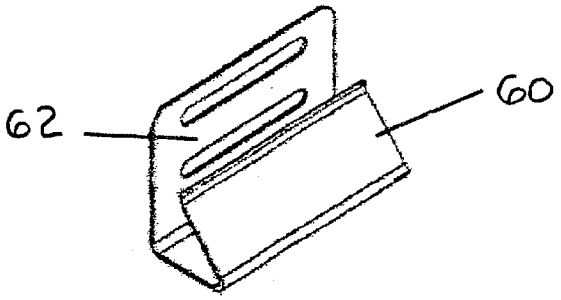
FIGS. 7A–7C illustrate an alternate embodiment of the grasping element constructed as a spring-loaded clip with integral adjuster for use with the head and neck support.
Figure 7B:
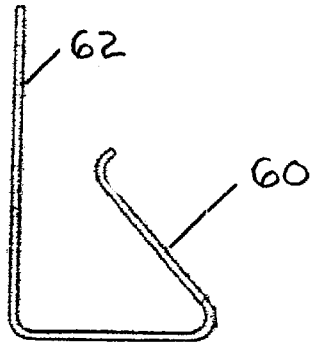
Figure 7C:
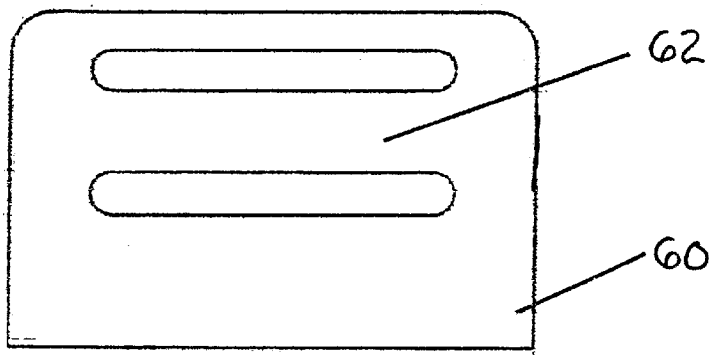

An alternate embodiment of a grasping element with an integral adjuster, comprising a spring-loaded clip 60 with an integral buckle 62, is illustrated in FIGS. 7A–7C. The clip 60 attaches under and to each side of the bowl's lip or spaced side edges. The spring-loaded aspect of the clip allows for use of the head and neck support with shampoo bowls having edges, or lip portions, each of differing thickness. The buckle 62 comprising a series of slots may be formed within each clip for allowing the ends of the strap to be threaded therethrough and adjusted in length or tension for shampoo bowls of varying width, and for raising the head of the client relative to the plane of the shampoo bowl. So constructed, the clip 60 will be adjustable to fit the lips or edges of a wide variety of shampoo bowls or sinks.

In any of the embodiments, for example those of FIG. 2 and FIGS. 6A–6C, the grasping elements 22 are preferably made of a rigid, semi-rigid, or a spring-like material, for example stainless or other steels, or of a rigid plastic or synthetic material, and may be coated with a suitable soft plastic material to prevent the elements from marring the finish of the shampoo bowl and to provide adequate grasping traction thereon.

Referring again to FIG. 2, the strap 20 may comprise a durable plastic or woven material, for example nylon, providing strength, resistance to bacterial growth, mold, and degradation due to repeated exposure to water and the hair and/or facial cleaning or treatment agents. The strap may be formed as a smooth surfaced or textured belt and is sized and shaped for convenient passage through the grasping elements 22 and the strap slots 28.

Although preferred embodiments of the invention have been disclosed in the foregoing specification, it is understood by those skilled in the art to which the invention pertains, that many modifications and other embodiments of the invention will come to mind, having the benefit of the teaching presented in the foregoing description. Accordingly, it is understood that the invention is not limited to specific embodiments disclosed herein, and that many modifications and other embodiments of the invention are intended to be included in the scope hereof. Moreover, although specific terms are employed herein, they are used in the generic and descriptive sense only, and are not intended to limit the scope of the invention.

We claim:

1. A head and neck support for being received within a shampoo bowl, the shampoo bowl having a pair of opposed side walls and a front wall with a neck depression defined therein, the head and neck support comprising:

at least one grasping element adapted to be received on the side walls of the shampoo bowl;

at least one elongate strap attached to the at least one grasping element; and a support piece comprising a head pan, an elongate tongue extended therefrom and adapted to be passed over the neck opening of the shampoo bowl, and at least one slot defined within and extended through the support piece for receiving the at least one strap therein, the at least one slot comprising a pair of first slots, the at least one strap being passed through each first slot, wherein the support piece further comprising a raised boss disposed intermediate the pair of first slots;

whereby, when the tongue is passed over the neck depression of the shampoo bowl and the at least one grasping element is received on the side walls thereof, the at least one strap and the tongue of the head pan suspend the support piece over and within the shampoo bowl.

2. The head and neck support of claim 1, the support piece further comprising an elongate shelf extended from the head pan opposite the tongue, said at least one first slot being defined within the shelf.

3. The head and neck support of claim 1, the at least one grasping element comprising a hook sized and shaped to be passed over the side walls of the shampoo bowl.

4. The head and neck support of claim 1, the at least one grasping element comprising a spring clip sized and shaped to be passed over the side walls of the shampoo bowl.

5. The head and neck support of claim 1, the support piece further comprising a pair of spaced arcuate cutouts defined by and on opposite sides of the tongue.

6. The head and neck support of claim 5, the support piece further comprising a pair of spaced shoulders formed by the respective arcuate cutouts, whereby when the support piece is suspended within the bowl the shoulders of the support piece abut the front wall of the bowl, one on each side of the neck depression thereof.

7. The head and neck support of claim 1, the support piece further comprising a pair of second slots defined within and extended through the support piece.

8. The head and neck support of claim 7, wherein the first pair of slots is positioned centrally on the support piece, and the second pair of slots is positioned outwardly of said first pair of slots, the at least one strap being passed through each slot within the first and the second pair of slots, respectively.

9. The head and neck support of claim 1, the at least one grasping element comprising a pair of grasping elements.

10. The head and neck support of claim 9, the support piece further comprising an elongate shelf extended from the head pan opposite the tongue, wherein the at least one slot is defined within and extended through the shelf.

11. The head and neck support of claim 9, further comprising a first strap attached to one of the grasping elements, and a second strap attached to the other one of the grasping elements, and an adjuster attached to each of the first strap and the second strap.

12. The head and neck support of claim 11, the adjuster being constructed and arranged to be selectively positioned on the first strap at a variable position in the lengthwise direction thereof, and being fixedly attached to the second strap.

13. The head and neck support of claim 11, wherein the adjuster is constructed and arranged to adjust the length of the first strap.

14. A head and neck support in combination with a shampoo bowl, the bowl having a pair of opposed side walls and a front wall with a neck depression defined therein, the head and neck support comprising:

a pair of grasping elements received on the side walls of the shampoo bowl;

at least one strap attached to each of the pair of grasping elements; and a support piece comprising a head pan, an elongate tongue extended therefrom and passed over the neck opening of the shampoo bowl, and at least one slot defined within and extended through the support piece for receiving the at least one strap therein, the at least one slot comprising a pair of first slots, the at least one strap being passed through each first slot, wherein the support piece further comprising a raised boss disposed intermediate the pair of first slots;

whereby, when the tongue is passed over the neck depression of the shampoo bowl and the respective grasping elements are received on the side walls thereof, the at least one strap and the tongue of the head pan suspend the support piece over and within the shampoo bowl.

15. The head and neck support of claim 14, the support piece further comprising a pair of spaced arcuate cutouts defined by and on opposite sides of the tongue and a pair of spaced shoulders formed by the respective arcuate cutouts, whereby when the support piece is suspended within the shampoo bowl with the tongue extended through the neck depression thereof the shoulders of the support piece abut the front wall of the bowl, one on each side of the neck depression.

16. The head and neck support of claim 14, wherein the at least one strap is constructed and arranged to be selectively adjustable in length.

17. A head support piece for being received within a shampoo bowl, the bowl having a pair of opposed side walls, and a front wall with a neck depression defined therein, the support piece comprising:

a head pan;

an elongate tongue extended from a first side of the head pan;

a pair of-spaced arcuate cutouts defined by and on opposite sides of the tongue;

a pair of spaced shoulders formed by the respective arcuate cutouts;

an elongate shelf extended from a second side of the head pan opposite the first side;

at least one shelf slot defined within and extended through the shelf, the at least one shelf slot comprising a pair of first slots, at least one strap being passed through each first slot, wherein the support piece further comprising a raised boss disposed intermediate the pair of first slots; and at least one drain opening defined within and extended through the head pan.

18. The support piece of claim 17, wherein the head pan is formed to have a concave depression therein.

19. The support piece of claim 17, wherein the at least one drain opening comprises a drain slot formed with a rounded peripheral edge defined within a top surface of the head pan, and has a continuous peripheral rib extended away from a bottom surface of the head pan extending along the periphery of the at least one drain slot.

20. The support piece of claim 17, further comprising a pair of side walls extended from the head pan along opposing third and fourth sides thereof.

21. The support piece of claim 17, further comprising a side wall extended from the head pan to the shelf along the second side thereof such that elevation of the head pan is greater than that of the shelf.

22. The support piece of claim 17, further comprising a pair of side walls extended from the tongue along opposite sides thereof, each said side wall being greater in height proximal the head pan and progressively lesser in height distal the head pan.

23. The support piece of claim 17, wherein a top surface of the support piece is textured.

24. The support piece of claim 17, further comprising a plurality of drain openings defined within the head pan and extending therethrough.

25. The support piece of claim 24, said plurality of drain openings comprising an elongate central drain slot formed centrally within the head pan and a plurality of arcuate drain slots disposed about the central drain slot.

* * * * *